US006488054B2

(12) United States Patent
Zenoni et al.

(10) Patent No.: US 6,488,054 B2
(45) Date of Patent: Dec. 3, 2002

(54) ANTI-BALLOON DEVICE FOR WEFT FEEDERS FOR WEAVING LOOMS

(75) Inventors: Pietro Zenoni, Leffe; Rosario Castelli, Gandino, both of (IT)

(73) Assignee: L.G.L. Electronics S.p.A., Gandino (IT)

( * ) Notice: Subject to any disclaimer, the term of this patent is extended or adjusted under 35 U.S.C. 154(b) by 0 days.

(21) Appl. No.: 09/828,215

(22) Filed: Apr. 9, 2001

(65) Prior Publication Data

US 2001/0035227 A1 Nov. 1, 2001

(30) Foreign Application Priority Data

Apr. 28, 2000 (IT) ..... TO00A0400

(51) Int. Cl.[7] ..... B65H 51/20; B65H 1/22; D03D 47/36

(52) U.S. Cl. ..... 139/452; 242/365.4

(58) Field of Search ..... 139/452; 242/365.4; 440/72

(56) References Cited

U.S. PATENT DOCUMENTS 3,761,031 A * 9/1973 Pfarrwaller ..... 139/452
3,802,377 A * 4/1974 Porter et al. ..... 115/42
4,013,033 A * 3/1977 Porter et al. ..... 115/42

* cited by examiner

*Primary Examiner*—Andy Falik
(74) *Attorney, Agent, or Firm*—Guido Modiano; Albert Josif; Daniel O'Byrne

(57) ABSTRACT

An anti-balloon device, to be placed downstream of a weft feeder for weaving looms, comprising a structure which forms a substantially tubular through cavity, preferably substantially frustum-shaped; the cavity is crossed by an unwinding thread that arrives from the weft feeder and controls the passage of the thread, by opposing the centrifugal force that affects it. The structure is shaped like a bottomless basket which is formed by rods lying longitudinally between end elements which connect the rods; the end elements are end rings which are mutually angularly spaced so as to surround the cavity in order to control the passage of the thread.

21 Claims, 3 Drawing Sheets

ANTI-BALLOON DEVICE FOR WEFT FEEDERS FOR WEAVING LOOMS

BACKGROUND OF THE INVENTION

The present invention relates to an anti-balloon device or the like, typically but not exclusively for weft feeders for weaving looms, and particularly for pre-measuring weft feeders for air jet looms.

As is known to the expert in the field, weft feeders are devices which are inserted between the spool and the loom and have the specific task of feeding the thread to the loom at each weft insertion, releasing it from a weft reserve accumulated by the device in the form of turns wound on a drum of the device; they also have the task of restoring the reserve by winding again onto the drum a number of turns equal to the unwound ones. Pre-measuring feeders furthermore have the task of measuring the length of thread released at each insertion, and for this purpose a pre-measuring feeder typically comprises a variable-diameter drum, on which a swiveling arm winds the turns that form the weft reserve, a weft braking finger for stopping the thread, which is associated with the drum and is actuated electromagnetically in order to release the thread, allowing it to unwind from the drum, and stop its unwinding once the pre-measured amount is reached, means for counting the turns released at each insertion, and means for counting the turns wound again in order to restore the weft reserve.

In devices of this type, due to the speed with which the turns of the reserve unwind from the drum, which is particularly high in pre-measuring feeders when the weft braking finger moves to the release position, the thread, urged by centrifugal force, arranges itself immediately downstream of the drum along the generatrices of a solid of revolution which is commonly known as "balloon", whose dimensions increase as the speed of the weaving process increases and as the mechanical tension of the thread decreases. It is well-known that the presence of the balloon causes severe problems in the weaving process, since it facilitates the formation of tangles of thread, knots and other discontinuities which interfere with the correct travel of the thread, often causing it to break.

In order to avoid these drawbacks, the above weft feeders are equipped with anti-balloon devices placed downstream of the drum on which the weft reserve is wound and having the task of restraining the thread as much as possible, thus reducing its tendency to expand radially due to centrifugal force.

Known anti-balloon devices are typically constituted by shield-like elements having a preferably frustum-shaped continuous lateral surface or skirt and forming a through cavity for the thread, the shield-like elements being arranged with their major base directed toward the drum; the shield-like elements receive the unwinding thread and guide it toward a terminal thread guiding ring, from which the thread is sent to the loom. Inside said frustum-shaped shield-like element, the thread rotates like the hand of a clock and remains, due to centrifugal force, in contact with the internal lateral surface of said shield-like element; this entails a double drawback. Firstly, the friction generated by contact between the thread and the lateral surface brakes the thread, subjecting it to an undesirable mechanical tension which increases as travel speed of the thread increases and as the friction between the thread and the lateral surface increases; secondly, rotation like the hand of a clock and the consequent sliding of the thread in contact with the lateral surface of the shield-like element generates lint and dust, which in turn jam the correct advancement of the thread, damaging the correct execution of the weaving process.

In an attempt to obviate these drawbacks and particularly to reduce the mechanical tension generated on the thread by its sliding against the internal lateral surface of the frustum-shaped shield-like element, it has been suggested to give a profile to said surface by providing it, for this purpose, with raised ridges protruding radially inside the lateral surface.

According to the prior EP-A3-449068, an anti-balloon device is provided in which the ridges protruding from the internal lateral surface of the frustum-shaped shield-like element trace a spiral shape around the longitudinal axis of the element. Additionally, according to the EP-0737161, the internal lateral surface of the shield-like element of the anti-balloon device is instead provided with straight protruding ridges which are orientated along the generatrices of said surface.

However, both these known solutions have failed to give the expected results.

With the spiral ridge arrangement, the thread in fact remains in any case in contact with the ridge and the braking action produced by friction does not vary significantly, owing to the fact that the decrease in contact surface between the ridge and the thread is mostly compensated, for an equal centrifugal force, by the increase in the specific pressure urging the thread against the ridge. Even with the straight-ridge arrangement, the total braking action applied by the anti-balloon device to the thread does not vary significantly, owing to the fact that in passing from one ridge to the next the thread slides at least over part of the lateral surface separating one ridge from the next, so that as a whole the friction between the lateral surface and the thread does not vary appreciably.

SUMMARY OF THE INVENTION

The aim of the present invention is to eliminate the above drawbacks.

Within this general aim, an important and particular object of the present invention is to provide an anti-balloon device for weft feeders as specified, which is suitable to effectively contain the unwinding thread and at the same time significantly reduce the friction applied to the thread and the mechanical tension accordingly generated thereon, particularly so as to make the friction adjustable according to the operating requirements.

Another important particular object of the present invention is to provide a self-cleaning anti-balloon device, i.e., an anti-balloon device which does not accumulate dust, lint and the like generated by the sliding of the thread and by its interaction with the anti-balloon device.

Another object of the invention is to provide an anti-balloon device which has a simplified structure, with replaceable components, reduced weight and bulk and suitable to allow effective and broad adjustment of the braking action applied to the thread, thus making the device suitable for threads of any count and type.

According to the present invention, this aim and these and other objects which will become better apparent from the detailed description that follows are achieved with an anti-balloon device, typically but not exclusively for textile thread feeders, particularly pre-measuring weft feeders as specified, having the specific characteristics defined in the appended claims.

Substantially, the invention is based on the concept of providing an anti-balloon device in which the continuous lateral surface of the frustum-shaped shield-like element is replaced by a bottomless basket-like structure comprising a set of cylindrical rods which are arranged, according to one of the embodiments, along the generatrices of an ideal frustum-shaped solid, are mutually angularly equidistant, and are connected by end elements and, in particular, removably connected to a pair of axially spaced end rings which have appropriate diameters and define the ideal frustum-shaped solid.

According to another embodiment of the invention, the ideal solid can be cylindrical or oval and cut in half along its maximum diameter.

According to still another embodiment, the basket can be provided starting from a single continuous rod or bar which is bent into a coil with straight formations running longitudinally, preferably substantially along the generatrices of the ideal geometric solid formed by the bottomless basket and with end formations, with respect to the basket, which are bent in a U-shape and are joined to the contiguous straight formations and are an integral part thereof.

According to still another embodiment of the invention, the cylindrical removable rods interposed between the end rings are straight, variable in number and chosen according to the friction that the device is allowed to apply to the type of thread being unwound without said thread being subjected to damage and breaks.

The invention might also be used in the front unwinding of the textile thread from a cross-wound spool.

BRIEF DESCRIPTION OF THE DRAWINGS

The characteristics, purposes and advantages of the anti-balloon device according to the present invention will become better apparent from the following detailed description and with reference to the accompanying drawings, given by way of non-limitative example and wherein.

DESCRIPTION OF THE PREFERRED EMBODIMENTS

Figure 1:
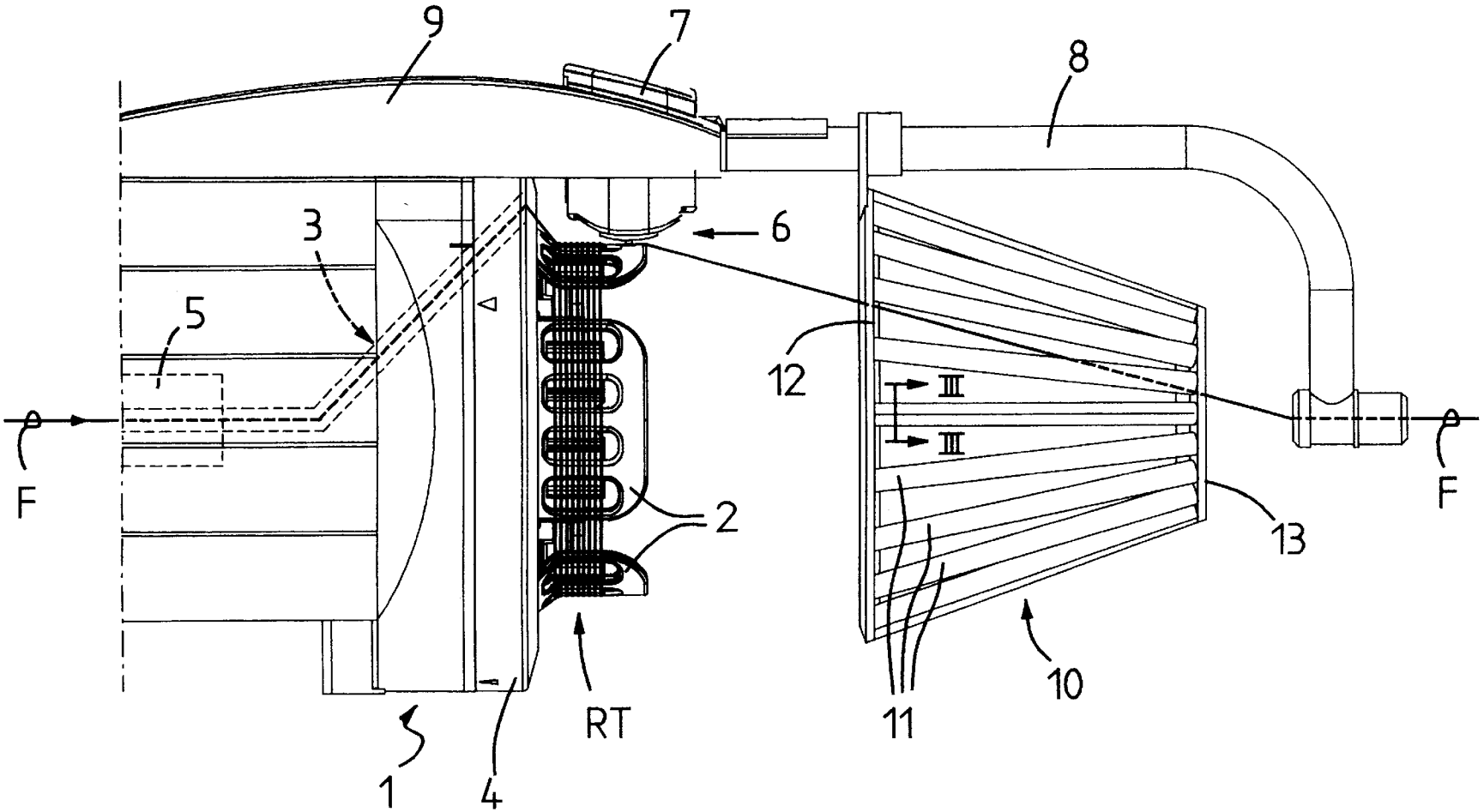
FIG. 1 is a side elevation view of a pre-measuring weft feeder with the anti-balloon device according to a preferred embodiment of the present invention.

In the drawings, the reference numeral 1 generally designates a pre-measuring weft feeder for fluid-jet weaving looms, particularly air jet looms. In a per se known manner, the feeder 1 comprises a fixed drum 2 of the variable-diameter type, on which a swiveling arm 3 associated with a flywheel 4 and driven by a motor 5 winds a plurality of turns of thread which constitute a weft reserve RT. A weft retention finger 6 for stopping the thread F is associated with the drum 2 of the feeder 1 and is actuated by an electromagnetic actuator 7 in order to release the thread, allowing it to unwind from the drum 2 and to stop its unwinding when the pre-measured insertion length is reached. A microprocessor (not shown), preset to manage the entire system for feeding the thread F, generates in a known manner signals for controlling the weft retention finger 6 and additional signals for controlling the motor 5, which on the basis of such control signals restores the turns that are gradually unwound, keeping the reserve RT substantially constant.

The anti-balloon device 10 is arranged substantially downstream of the feeder 1, in front of the drum 2 and coaxially thereto, and is supported, so as to allow to adjust its axial position with respect to the drum 2, by a cantilevered support 8 which is rigidly coupled to the rigid body 9 of the feeder 1.

Figure 4:
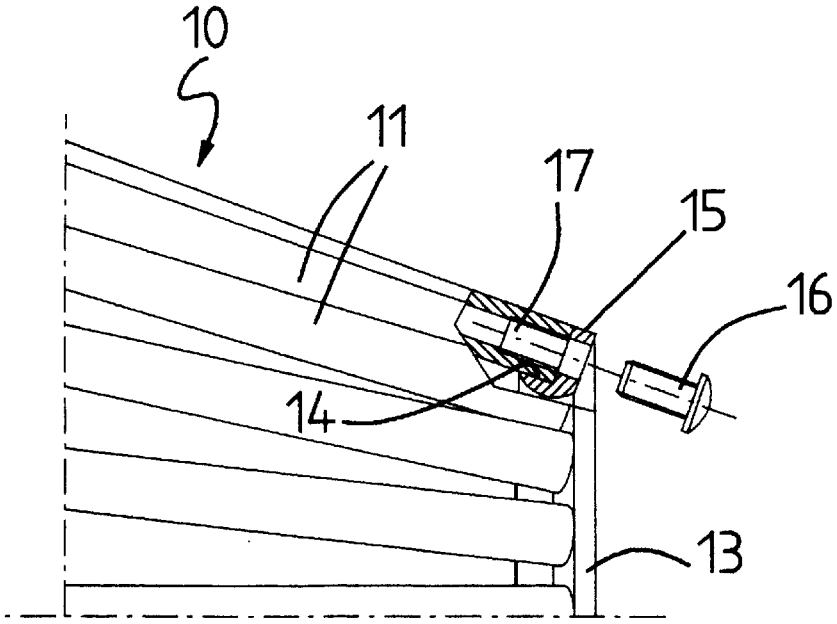
FIG. 4 is an enlarged-scale view of a detail, illustrating the manner in which the rods are detachably connected to the end rings.

According to the present invention, the anti-balloon device 10 is constituted by a basket-like structure forming a substantially tubular through cavity delimited by a plurality of cylindrical rods 11 being detachably connected to two end rings 12 and 13 having different diameters and arranged so as to be mutually spaced in an axial direction. The rods 10 and said rings 12 and 13 form an ideal frustum-shaped solid, in which the largest end face, directed toward the drum 2 of the feeder 1, is delimited by the end ring 12 with the largest diameter and the smallest end face is delimited by the ring 13 with the correspondingly smallest diameter, with preferably straight generatrices which coincide with the correspondingly straight axis of the rods 11. As clearly shown in the detail view of FIG. 4, detachable connection means are interposed between said rods and said end rings 12 and 13. According to a preferred embodiment of the invention, the connection means are constituted by seats 14 which are provided on respective inclined collars 15 of both rings and suitable to receive the corresponding ends of the rods 11. Screws 16 are associated with the seats 14 in order to engage corresponding threaded holes 17 provided at the ends of the rods and prevent their extraction from the seats.

Figure 3A:
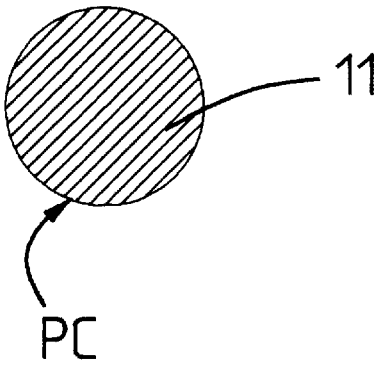
FIGS. 3*a* and 3*b* are highly enlarged sectional views, taken along the plane III—III of FIG. 1, similar to FIGS. 2*a* and 2*b*, illustrating corresponding alternative profiles of the rods that compose the device.
Figure 3B:
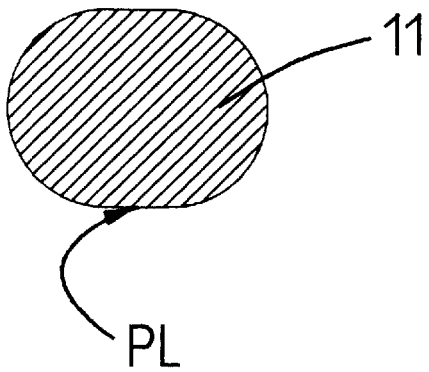

Advantageously, according to the invention, the cylindrical rods 11 are made of light metals or alloys thereof, typically aluminum and alloys thereof, and are surface-hardened by chromium plating or by depositing a layer of alumina or by means of other known surface treatments suitable for the purpose. Additionally, the rods 11 typically have a circular cross-section, as designated by PC in FIG. 3*a*, or a lens-shaped cross-section PL, as shown in FIG. 3*b*.

According to the invention, the angular spacing of the rods 11 on the end rings 12–14 is chosen equal to 3–4 times the diameter of the rods. In any case, said angular spacing is variable in relation to the maximum braking action that the anti-balloon device 10 is allowed to apply to the thread F being unwound.

Figure 2A:
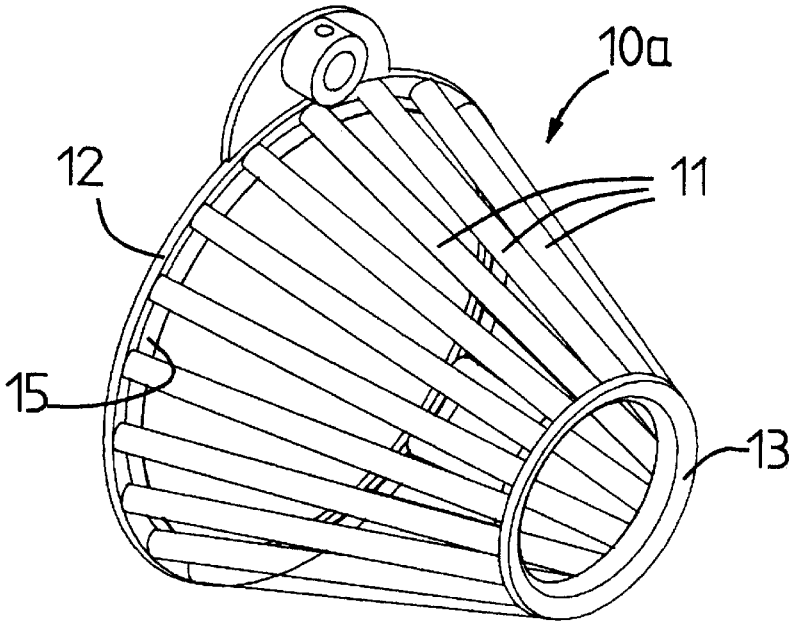
FIGS. 2*a* and 2*b* are perspective views of anti-balloon devices according to the invention which differ in terms of the number of rods.
Figure 2B:
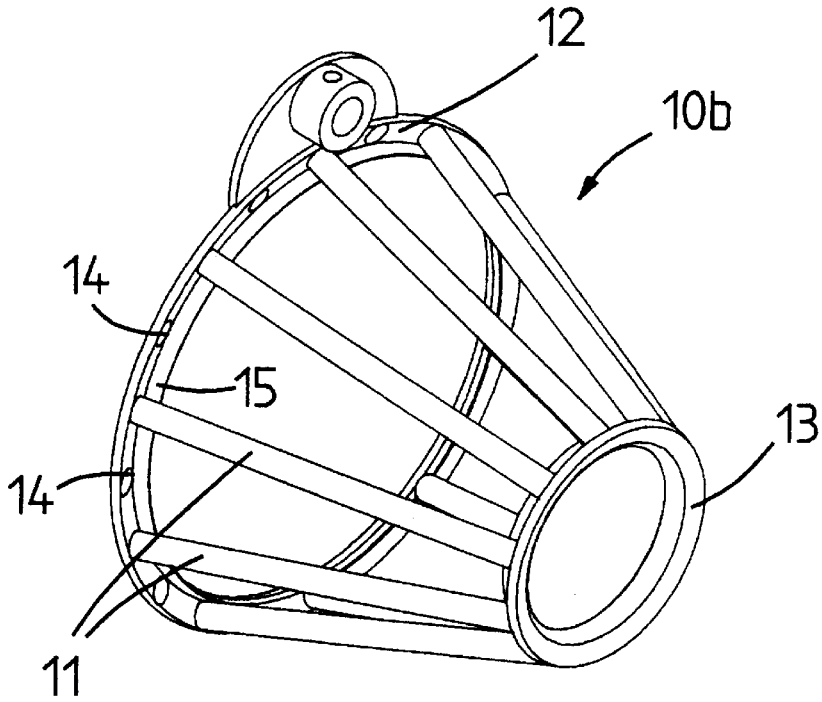

Typically, two different angular spacings of the rods 11, suitable for smaller-count threads and for larger-count threads respectively, are obtained by passing from the basket configuration 10*a* shown in FIG. 2*a*, in which the basket has as many rods as there are seats 14 provided in the end rings 12 and 13, to the configuration 10*b* shown in FIG. 2*b*, in which the seats are left alternately free and the angular spacing between the rods 11, which are consequently reduced in number and more broadly separated, is twice that of the preceding configuration.

It should also be noted that the rotation of the thread F inside the basket of the above described device 10 generates a significant ventilation effect, with radial flow components being predominant, and which, in accordance with the above aim and objects, prevents the accumulation of dust and lint, evacuating them outside the device through the empty spaces comprised between the rods 11.

Without altering the concept of the invention, the details of execution and the embodiments may of course be altered extensively with respect to what has been described and illustrated by way of non-limitative example without thereby abandoning the scope of the invention.

The disclosures in Italian Patent Application No. TO2000A000400 from which this application claims priority are incorporated herein by reference.

What is claimed is:

1. An anti-balloon device, to be placed downstream of a textile weft feeder for weaving looms, comprising a structure which forms a substantially tubular through cavity which is substantially frustum-shaped and for being crossed by an unwinding thread coming from said feeder and for controlling the passage of the thread through said cavity, opposing the centrifugal force that affects said thread, wherein said structure is shaped like a bottomless basket which comprises formations of rods lying longitudinally with respect to said tubular shape of said through cavity, said formations of rods being angularly spaced around said tubular through cavity in order to circumscribe said cavity in a grid-like fashion and control the passage of said thread through said cavity, connecting formations being also provided in order to mutually join said longitudinally extending rods, and wherein the cylindrical rods have a lens-shaped profile in cross section.

2. The device according to claim 1, wherein said connecting formations are shaped like end rings with which said formations of longitudinal rods are associated.

3. The device according to claim 1, wherein said connecting formations are portions, bent into a U-shape, of said rod formations which are joined to said rod formations in order to be an integral part thereof.

4. The device according to claim 2, wherein the rods that lie between said end rings have respective ends which are detachably connected to said end rings.

5. The device according to claim 2, wherein said end rings have different diameters and form, together with said cylindrical rods, an ideal frustum-shaped solid, and wherein said rods are directed along the generatrices of said ideal frustum-shaped solid.

6. The device according to claim 1, wherein the cylindrical rods have a straight axis.

7. The device according to claim 1, wherein the cylindrical rods have a circular profile in cross section.

8. The device according to claim 1, wherein the cylindrical rods are made of light metals or alloy thereof and are surface-hardened by means of one of the following treatments: chromium plating or deposition of a layer of alumina.

9. The device according to claim 2, wherein the angular spacing of the rods on the end rings is chosen equal to at least 3 times the diameter of said rods and is variable in relation to a maximum braking action that the anti-balloon device is allowed to apply to the unwinding thread.

10. The device according to claim 2, comprising detachable connection means which are interposed between said rods and said end rings, said connection means being constituted by cylindrical seats which are provided on corresponding inclined collars of both rings and are adapted to receive the corresponding ends of the rods; screws being associated with said cylindrical seats in order to engage respective threaded holes provided at the ends of the rods and to prevent their extraction from the respective seats.

11. A textile weft feeder for weaving looms, comprising a drum and a swiveling arm that winds a plurality of turns of thread on the drum, an anti-balloon device being arranged downstream of said drum, said anti-balloon device comprising a structure which forms a substantially tubular through cavity which is substantially frustum-shaped for being crossed by a unwinding thread coming from said feeder and is for controlling the passage of the thread through said cavity, opposing the centrifugal force that affects said thread, wherein said structure is shaped like a bottomless basket which comprises formations of rods lying longitudinally with respect to said tubular shape of said through cavity, said formations of rods being angularly spaced around said tubular through cavity in order to circumscribe said cavity in a grid-like fashion and control the passage of said thread through said cavity, connecting formations being also provided in order to mutually join said longitudinally extending rods.

12. The weft feeder of claim 11, wherein said connecting formations are shaped like end rings with which said formations of longitudinal rods are associated.

13. The weft feeder of claim 11, wherein said connecting formations are portions, bent into a U-shape, of said rod formations which are joined to said rod formations in order to be an integral part thereof.

14. The weft feeder of claim 12, wherein the rods that lie between said end rings have respective ends which are detachably connected to said end rings.

15. The weft feeder of claim 12, wherein said end rings have different diameters and form, together with said cylindrical rods, an ideal frustum-shaped solid, and wherein said rods are directed along the generatrices of said ideal frustum-shaped solid.

16. The weft feeder of claim 11, wherein the cylindrical rods have a straight axis.

17. The weft feeder of claim 11, wherein the cylindrical rods have a circular profile in cross section.

18. The weft feeder of claim 11, wherein the cylindrical rods have a lens-shaped profile in cross section.

19. The weft feeder of claim 11, wherein the cylindrical rods are made of light metals or alloy thereof and are surface-hardened by means of one of the following treatments: chromium plating or deposition of a layer of alumina.

20. The weft feeder of claim 12, wherein the angular spacing of the rods on the end rings is chosen equal to at least 3 times the diameter of said rods and is variable in relation to the maximum braking action that the anti-balloon device is allowed to apply to the unwinding thread.

21. The weft feeder of claim 12, comprising detachable connection means which are interposed between said rods and said end rings, said connection means being constituted by cylindrical seats which are provided on corresponding inclined collars of both rings and are adapted to receive the corresponding ends of the rods; screws being associated with said cylindrical seats in order to engage respective threaded holes provided at the ends of the rods and to prevent their extraction from the respective seats.

* * * * *